United States Patent [19]

Schiele

[11] 4,130,479

[45] Dec. 19, 1978

[54] REPLACEABLE LINER FOR CENTRIFUGE SIEVE

[75] Inventor: Herbert Schiele, Kettwig, Germany

[73] Assignee: Krauss-Maffei Aktiengesellschaft, Munich, Germany

[21] Appl. No.: 641,621

[22] Filed: Dec. 17, 1975

[30] Foreign Application Priority Data

Dec. 19, 1974 [DE] Fed. Rep. of Germany ..... 2460167

[51] Int. Cl.[2] ..... B07B 1/46

[52] U.S. Cl. ..... 209/395; 209/288; 210/380 R; 241/183

[58] Field of Search ..... 209/395, 393, 98, 99, 209/270, 410, 411; 241/183; 210/380, 380 M, 498, 394, 284, 288; 162/357; 233/1 E; 29/455; 34/58; 165/8

[56] References Cited

U.S. PATENT DOCUMENTS

| | | | |
|---|---|---|---|
| 139,110 | 5/1873 | Bovey | 209/395 X |
| 546,447 | 9/1895 | Grugin | 209/394 |
| 811,679 | 2/1906 | Williams | 209/394 X |
| 1,006,649 | 10/1911 | Gilbert | 209/270 X |
| 1,043,196 | 11/1912 | Bowers | 209/395 |
| 1,064,459 | 6/1913 | Bovery | 209/394 X |
| 1,275,713 | 8/1918 | McKee | 209/395 |
| 1,307,952 | 6/1919 | Ball | 241/183 |
| 1,309,805 | 7/1919 | Lincoln | 209/395 X |
| 1,571,675 | 2/1926 | Knight | 209/393 X |
| 2,086,551 | 7/1937 | Keller | 209/407 X |
| 2,916,145 | 12/1959 | Kaiser | 209/394 X |
| 2,942,730 | 6/1960 | Fontein | 209/274 |
| 2,967,620 | 1/1961 | Bixby | 209/395 |
| 3,270,050 | 9/1885 | Wulfert | 209/394 X |
| 3,684,099 | 8/1972 | Kiebach | 210/38 X |

FOREIGN PATENT DOCUMENTS

| | | | |
|---|---|---|---|
| 952520 | 11/1956 | Fed. Rep. of Germany | 209/395 |
| 1348311 | 11/1963 | France | 241/183 |
| 189166 | 4/1964 | Sweden | 162/357 |

*Primary Examiner*—Robert Halper
*Attorney, Agent, or Firm*—Karl F. Ross

[57] ABSTRACT

A centrifuge sieve has a support drum rotatable about an axis, a pair of axially spaced rings secured in the drum and centered on the axis, and an array of like sieve bars having radially inner surfaces defining a body of revolution centered on the axis. The bars each have opposite ends each in turn having two formations radially outside the body. One of these formations engages over and radially inside the respective ring and the other formation engages radially outside and under the ring. Thus the rings lie outside the body and underneath lateral projections serving circumferentially to space adjacent bars apart. The upper surfaces of the lateral spacing projections lie below the radial inner surfaces of the bars and at least one end of each bar is chamfered to reduce the change of material catching on the bar.

7 Claims, 12 Drawing Figures

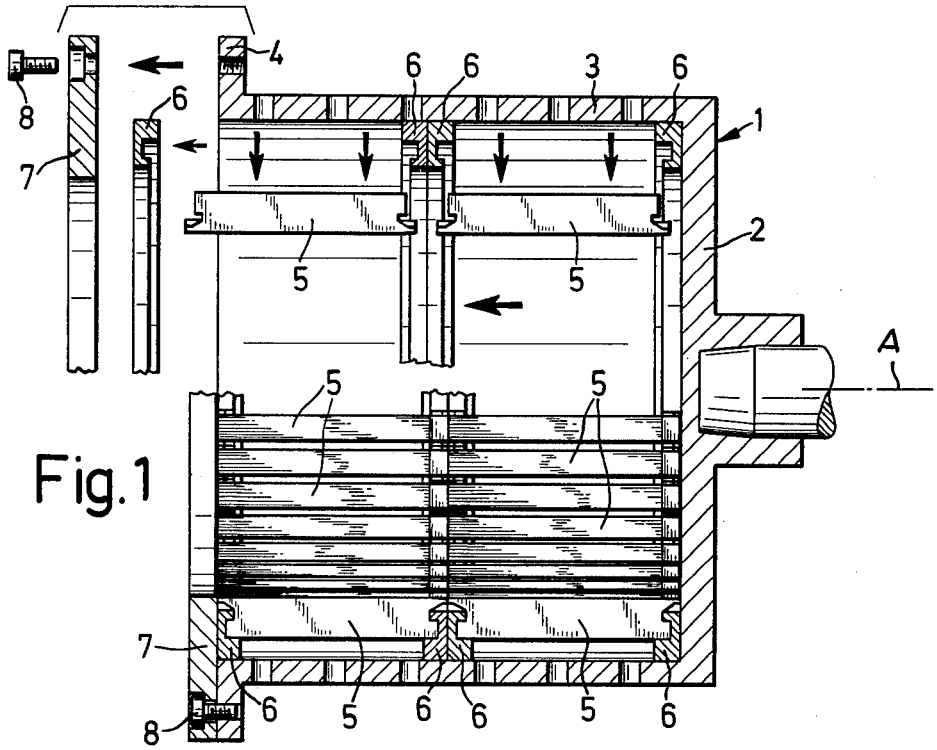
Fig. 1
Fig. 2a
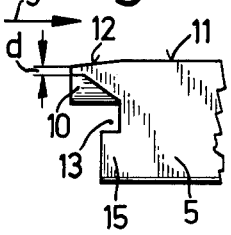
Fig. 2b
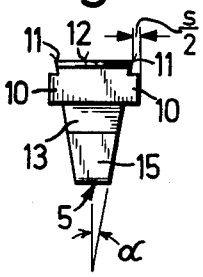
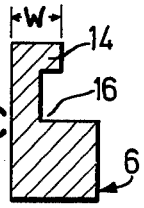
Fig. 2c
Fig. 3
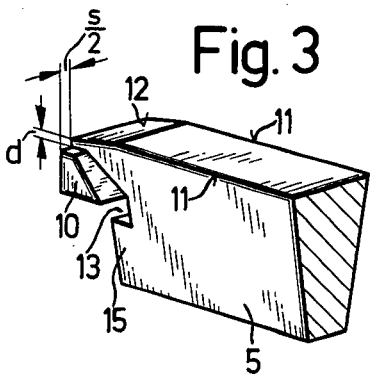

Fig. 4
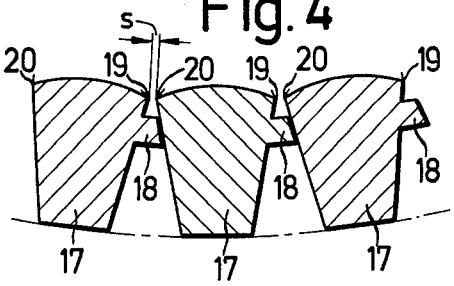
Fig. 5
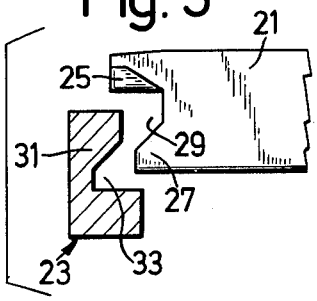
Fig. 6
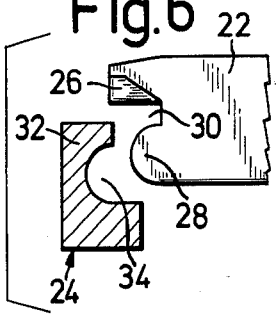
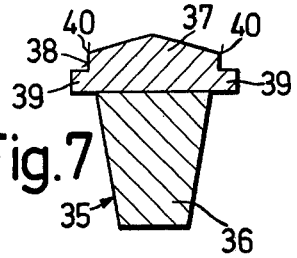
Fig. 7
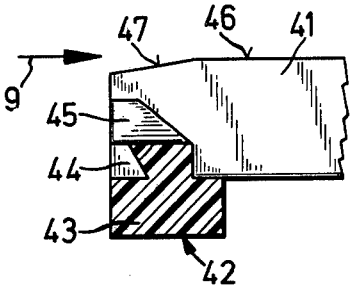
Fig. 8
Fig. 9a
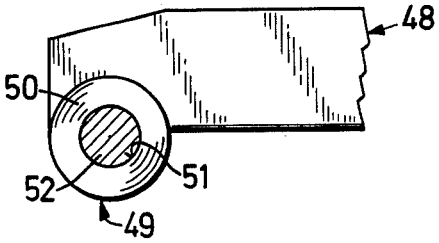
Fig. 9b
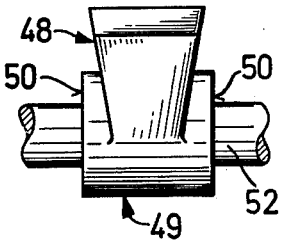

REPLACEABLE LINER FOR CENTRIFUGE SIEVE

FIELD OF THE INVENTION

The present invention relates to a sieve. More particularly this invention concerns a sieve drum usable in a centrifuge or the like.

BACKGROUND OF THE INVENTION

A sieve is known for a centrifuge that has a drum which is rotated about an axis and is provided on its inside surface with a plurality of bars spaced radially inwardly from the inner surface of the drum and themselves forming a body of revolution centered on the rotation axis of the drum. The drum is perforated or otherwise foraminous and the bars are spaced circumferentially apart so that when spun at high speed, liquid and particles small enough to slip between the bars are driven centrifugally radially outwardly and the larger particles are trapped within the body of revolution formed by the inner surfaces of the bars. See German Gebrauchsmuster No. 1,928,975 and German Pat. No. 952,520.

When such a sieve is used in a centrifuge for heavy-duty dewatering or separation the solid fraction that is retained within the drum usually erodes the bars constituting this inner surface greatly. To this end these bars are usually fitted within the drum to holder rings each formed with a circumferential array of alternating notches and teeth. Each bar is fitted between two such rings within a notch in each of the rings and is secured in place there, usually by bolting at each end of each bar.

Since the circumferential spacing between the bars determines the size of the fraction retained within the centrifuge it is essential that the bars be exactly positioned relative to one another. It is also necessary to be able to replace worn bars with new ones in the event that the bars have worn so greatly that their spacing has increased beyond a permissible limit. In the above-described system it is therefore necessary to unbolt the separate bars and replace them individually in a complicated and time-consuming operation.

Another disadvantage of the known arrangement is that the support rings must be very carefully machined in order to maintain an accurate spacing between adjacent bars. Thus the support rings are relatively expensive. Furthermore the support rings are exposed at the gaps between the bars so that with time even these rings must be replaced, an operation which is not only difficult but entails considerable expense. Furthermore the bars are not reusable so that altogether new ones must be placed in the sieve for relining it.

OBJECTS OF THE INVENTION

It is therefore an object of the present invention to provide an improved sieve.

Another object is the provision of a sieve with a replaceable lining for use in a centrifuge or the like.

Yet another object is to provide such a centrifuge sieve which overcomes the above-given disadvantages of the known types.

SUMMARY OF THE INVENTION

These objects are attained according to the present invention in a sieve wherein the sieve bars each have opposite ends each having two formations radially outside the body of revolution formed by the radially inner side of the sieve bars. One of these formations engages over and radially inside the respective holding ring carried on the rotatable support drum and the other engages under and radially outside the respective rings. Thus these rings lie radially outside the body of revolution defined by the inner faces of the bars. With this system it is possible most efficiently to use the interior space in the drum. Furthermore changing of one or all of the sieve bars is a very simple operation. The holding ring need not be made of expensive wear-resistant material as it lies outside the inner working surface of the sieve and, therefore, is subjected to minimal abrasion.

In accordance with further features of this invention each of the bars is formed at each of its ends with a laterally extending projection engageable with the adjacent end of the adjacent bar. These projections serve to space the bars circumferentially apart and they are radially inward and axially aligned with the support rings so as to shield these rings. Thus the support ring, which as mentioned above need not be made of expensive wear-resistant material, is further shielded by the projections which simultaneously serve to circumferentially space the bars. This again reduces production cost for the support rings which can be of regular cross sectional shape.

The inner surface of each of the projections according to yet another feature of this invention is spaced radially outwardly of the body of revolution formed by the inwardly convex inner surfaces of the bars. Thus these projections are not subject to more than nominal wear so that they do not wear down and vary the circumferential spacing between adjacent bars.

In accordance with yet another feature of this invention, each of the bars is made of a pair of parallel parts. One part is made of wear-resistant but replaceable material and extends along the radially inner surface of the entire bar. The other part is releasably secured to this inner part so that it is possible to reuse the major portion of any of the bars when the sieve is being relined. The inner part can be of hardened or sintered metal.

Removal of worn or damaged bars and reworking of individual bars is possible in accordance with another feature of this invention is an arrangement wherein each of the bars is metallic and is formed at each end with a radially inwardly widening and radially outwardly opening groove. The ring is formed of synthetic-resin material and fills the grooves or notches of all of the bars. The bars may be freed from the synthetic-resin rings by melting the rings or breaking them apart. The production of such support rings can be carried out by molding in situ a synthetic-resin mass or by pressing the bars against a heat-softened ring by means of a cone-shaped or cylinder-shaped tool.

According to yet another feature of this invention the ends of the bars are formed as eyes having throughgoing bores extending circumferentially of the body of revolution formed by the inner surfaces of the bars, and generally perpendicular to the longitudinal axes of the bars. Holding rods bent to the curvature of the body of revolution are received in the bores of such eyes and the ends of such rods may be soldered together or simply overlapped.

In a normal centrifuge the liquid flows radially outwardly, but the particles not able to pass between the bars flow in a predetermined axial direction. According to this invention the bars are formed on their inner surfaces at the ends turned in this direction with chamfers. In a sieve having a plurality of such arrays of bars arranged axially in line with one another all of the ends turn toward the direction of the particle flow have such chamfers so as to reduce wear. In such an arrangement the possibility that particles catch on the ends of the bars and remain there is almost fully eliminated.

BRIEF DESCRIPTION OF THE DRAWING

FIG. 1 is an axial section through a sieve drum in accordance with this invention, partly shown in dismantled exploded condition;

FIGS. 2*a* and 2*b* are side and end views, respectively, of an end of a bar in accordance with this invention;

FIG. 2*c* is a cross section through a holding ring usuable with the bars of FIGS. 2*a* and 2*b;*

FIG. 3 is a perspective view of the bar end shown in FIGS. 2*a* and 2*b;*

FIG. 4 is a cross section through a plurality of bars in accordance with this invention;

FIGS. 5 and 6 are views illustrating bar ends and support rings according to other features of this invention;

FIG. 7 is a cross section through a bar of this invention;

FIGS. 8 and 9*a* are views similar to FIG. 5 through other arrangements in accordance with this invention; and FIG. 9*b* is an end view of the detail shown in FIG. 9*a*.

SPECIFIC DESCRIPTION

The arrangement shown in FIG. 1 has a drum 1 rotatable about an axis A and formed with a perforated side wall 3 one end of which terminates at an end plate 2 and the other end of which carries a radially outwardly extending flange 4. Two arrays of bars 5 extending parallel to the axis A are held in place within the drum by means of rings 6, with a clamping ring 7 secured by screws 8 to the flange 4 in order to hold the bars 5 and securing rings 6 in place within the drum 1. Removal of this ring 7 as shown on the top of FIG. 1 allows the bars 5 and rings 6 to be removed from within the drum 1.

FIGS. 2*a*, 2*b*, and 2*c* illustrate how each of the beams 5 is formed on each end with a pair of laterally oppositely extending projections 10 which extend beyond the corners 11 of the upper surface of the beam 5 by a distance equal to s/2, so as to space the beams circumferentially apart by a distance s. In addition at least one end of each beam is formed with the chamfer 11 which terminates at the end of the beam a distance d above the upper surface of the projections 10. This distance d is greater than the maximum distance a particle being sieved by the apparatus would project between adjacent edges 11 of beams 5.

In addition each of the bars 5 is formed at its end with a notch 13 underneath the projections 10 and above an axially extending projection 15. These formations allow the ends of the beams 5 to mate with the rings 6 shown in FIG. 2*c*, with the projection 15 fitting within a notch 16 of the ring 6 and a projection 14 of the ring 6 being received within the groove 13 of the beam 5. In addition the radially inner surface of the ring 6 has an axial length w exactly equal to the axial length of the under surface of the right-trapezoidal section projections 10. These projections 10 lie directly on top of the inner surface of the ring 6 and completely protect it from friction wear.

The end of each bar 5 turned toward the direction 9 of particle flow in the apparatus is formed with a chamfer 12. This formation prevents particles from being caught between adjacent bars.

The bars 5 are of isosceles trapezoidal shape, with the angle $\alpha$ between the side and the center symmetry line of each bar being equal to 360/2n, n being the number of bars being provided in each array. The end faces of the projections 10 may be similarly inclined. Thus the side surfaces of adjacent bars are parallel to one another.

FIG. 4 shows a generally trapezoidal-section bar 17 whose edges 19 and 20 of their cylindrically convex upper surfaces are spaced apart by the distance s. To this end projections 18 provided on only one side of each bar are employed.

The arrangement in FIG. 5 has a bar 21 formed at its end with a notch 29 over a projection 27 receivable in a ring 23 with the notch 29 receiving a projection 31 and the projection 27 being received within a notch 23. In this case the notch 29 and the projection 27 are complementary right trapezoids. The spacers 25 are similar to those of FIGS. 2*a–c*.

The arrangements in FIG. 6 has a bar 22 with a notch 30 and a projection 28 under lateral projections 26. The holding ring 24 has a projection 32 and a groove 34. This arrangement fits together as described above with reference to FIG. 5, but the projection 28 and groove 34 are both of semicircular section.

The bar 35 of FIG. 7 comprises an isosceles trapezoidal lower section 36 surmounted by a cap 37 formed between its upper corners 40 with a convex and roof-shaped upper surface. Lateral projections 39 are formed with the bottom of the side surfaces 38 of the wear-resistant upper portion 37 that is releasable secured to the lower portion 36. It is possible in such a system to make the upper portion 37 of wear-resistant material whereas the lower portion 36, which merely withstands bending stress, can be made of cheaper material.

In FIG. 8 the bar 41 has an upper surface 46 and an end chamfer 47 opposite the direction 9 of particle flow. In addition this bar 41 has lateral projections 45 and is formed with a downwardly extending tongue 44 at its end that defines a radially outwardly opening but radially inwardly widening groove in which is received a ridge of a ring 42 made of synthetic-resin material 43.

The arrangement of FIGS. 9*a* and 9*b* has a bar 48 formed on its end with a cylindrical sleeve-like eye 49 having a throughgoing bore 51 receiving a holding ring 52. The end surfaces 50 of this eye 49 are engageable with similar surfaces 50 of adjacent bars 48 in order to circumferentially space the bars 48 apart.

I claim:

1. A centrifuge sieve comprising:

a support drum rotatable about an axis;

a pair of axially spaced rings secured in said drum and centered on said axis; and a multiplicity of sieve bars disposed in a cylindrical array and having radially inner sides defining a sieve surface of revolution centered on said axis, said bars being held together at their opposite ends by said ring by engaging same with a shape-locking plug-in connection, each of said plug-in connections comprising an element on the respective bar and a mating element on the respective ring, the mating elements interengaging in a claw-like manner, both of said rings and all of said elements being totally outside said surface, each of said bars being formed at each of its ends with a laterally extending projection engageable with the adjacent end of the adjacent bar and serving to space said bars circumferentially apart, said projections being radially inward and axially aligned with said rings to shield same, each of said projections having a radially inner surface radially outwardly of said body.

2. The sieve defined in claim 1 wherein each of said bars has a generally axially extending radially inner part defining said surface and made of wear-resistant material and parallel thereto and secured radially thereto a radially outer part.

3. The sieve defined in claim 1 wherein each of said bars is metallic and is formed at each end with a radially inwardly widening and radially outwardly opening groove whose radially outer edge constitutes a respective one of said elements, said rings being formed of moldable synthetic-resin material and filling said grooves.

4. The sieve defined in claim 1 wherein each of said bars is straight and parallel to said axis and is formed at each end with an axially opening notch having a radially inner portion constituting said one formation and a radially outer portion constituting said other formation, said portions forming the flanks of said notch.

5. The sieve defined in claim 1 wherein said bars each have at each end a pair of oppositely laterally extending projections each laterally engageable with another such projection of a neighboring bar.

6. The sieve defined in claim 1 wherein said sieve bars are provided with projections holding said bars in mutually spaced relation, said projections being disposed closer to said surface than said elements to shield said elements against fluid flowing toward the slots in said surface.

7. A sieve comprising:

a support drum rotatable about an axis;

a pair of axially spaced rings secured in said drum and centered on said axis; and an array of like sieve bars having radially inner sides defining a body of revolution centered on said axis, said bars each having opposite ends each having two formations radially outside said body one of which engages over and radially inside the respective ring and the other of which engages under and radially outside the respective ring, wherein said rings lie radially outside said body, each of said bars being formed at each of its ends with a laterally extending projection engageable with the adjacent end of the adjacent bar and serving to space said bars circumferentially apart, said projections being radially inward and axially aligned with said rings to shield same, each of said bars being straight and parallel to said axis and formed at each end with an axially opening notch having a radially inner portion constituting said one formation and a radially outer portion constituting said other formation, said portions forming the flanks of said notch.

* * * * *